United States Patent [19]

Wendel et al.

[11] 4,424,773

[45] Jan. 10, 1984

[54] VALVE ROTATOR

[75] Inventors: Nikolaus Wendel, Kierspe; Joachim Plener, Halver, both of Fed. Rep. of Germany

[73] Assignee: Märkisches Werk GmbH, Halver, Fed. Rep. of Germany

[21] Appl. No.: 290,508

[22] Filed: Aug. 6, 1981

[30] Foreign Application Priority Data

Aug. 8, 1980 [DE] Fed. Rep. of Germany ..... 3029988
Apr. 7, 1981 [DE] Fed. Rep. of Germany ..... 3113944
Jul. 16, 1981 [DE] Fed. Rep. of Germany ..... 3128086

[51] Int. Cl.[3] ..... F01L 1/32
[52] U.S. Cl. ..... 123/90.29; 123/90.3
[58] Field of Search ..... 123/90.28, 90.29, 90.30

[56] References Cited

U.S. PATENT DOCUMENTS 1,414,499 5/1922 Buck ..... 123/90.28
1,479,169 1/1924 Buck ..... 123/90.28
1,513,741 11/1924 Buck ..... 123/90.28
1,520,273 12/1924 Anthony ..... 123/90.28
2,609,804 9/1952 Doughty ..... 123/90.28
3,068,848 12/1962 Knocke ..... 123/90.3
4,141,325 2/1979 Shalaty ..... 123/90.3

*Primary Examiner*—Craig R. Feinberg
*Assistant Examiner*—W. R. Wolfe
*Attorney, Agent, or Firm*—Karl F. Ross; Herbert Dubno

[57] ABSTRACT

A valve rotator is effective between a valve stem of an internal-combustion engine and a support, normally the cylinder head. The rotator comprises an upper spring plate, a lower spring plate spaced along an axis below this upper plate, a compession spring braced axially between the plates, a two-part link element having an upper part rotationally secured to the valve stem and a lower part rotationally fixed in at least one rotational direction relative to the axis on the lower plate, and a unidirectional clutch between the lower part and the support and permitting the lower part to rotate about the axis only in the one direction relative to the support. Normally the lower plate is rotatable relative to the upper plate and the lower part is generally cylindrical, centered on the axis, and fixed rotationally on the lower plate. The clutch is also normally provided between the lower plate and part and the support. Such a rotator is connected with the clutch so that it turns with the valve.

6 Claims, 10 Drawing Figures

VALVE ROTATOR

FIELD OF THE INVENTION

The present invention relates to a valve rotator. More particularly this invention concerns such a device used to rotate the intake and/or exhaust valves of an internal-combustion engine.

BACKGROUND OF THE INVENTION

It has been found advantageous to rotate the valves of an internal-combustion engine each time same are opened and/or closed for a wiping action that has been found to keep the valves clean and to greatly increase the valve service life. Such rotators are described in U.S. Pat. Nos. 1,520,272 and 1,610,409.

German published patent application 2,841,489 describes a valve rotator using a pair of coil springs that are nested within each other and that are of opposite hand. Each such spring is connected via a respective oppositely effective one-way clutch to one of two spring plates between which it is braced, so that as the valve stem connected to one of these plates moves up and down it is rotated in angular increments by the springs, with a short rotation with each upward movement and a short rotation in the same direction with each downward movement. The disadvantage of this system is that the valve rotation rate is directly related to engine speed. Furthermore the rotation is dependent on many factors, such as friction in the valve guide, inertia, and the like that have different effects at different speeds.

Further rotators are known from German patent documents 1,955,820, 2,110,708, 2,116,086, 2,640,383, and 2,757,455 which all have roller or slide bodies that concentrically surround a base provided with pockets having angled flanks. Springs arranged at an angle to the displacement direction of these bodies bear on these flanks so that as the valve opens they are loaded, and when the valve closes the force stored in them turns the valve an increment. Such an arrangement aims at uniform rotary displacement of the valve. The mechanism is, however, so very complex that this arrangement normally has a short service life, it being noted that such a valve rotator is subject literally to millions of actuations during its normal service life.

Other complicated structures that are connected to the upper spring plate of the valve spring are described in German patent documents 2,054,349, 2,054,351, 2,054,362, 2,128,110, and 2,739,403. Installation of these arrangements in existing engines is virtually impossible. In addition they are normally so bulky that they cannot be employed in engines intended to operate at high RPM due to their large inertia.

OBJECTS OF THE INVENTION

It is therefore an object of the present invention to provide an improved valve rotator.

Another object is the provision of such a rotator which can be installed in a standard internal-combustion engine of virtually any type.

Yet another object is to provide a valve rotator which is relatively simple so that it can be sure of having a long service life.

SUMMARY OF THE INVENTION

These objects are attained according to the instant invention in a valve rotator effective between a valve stem and a support. According to this invention the rotator comprises an upper spring plate, a lower spring plate spaced along an axis below this upper plate, a compression spring braced axially between the plates, a two-part link element having an upper part rotationally secured to the valve stem and a lower part rotationally fixed in at least one rotational direction relative to the axis on the lower plate, and a unidirectional clutch between the lower part and the support and permitting the lower part to rotate about the axis only in the one direction relative to the support. Normally the lower plate is rotatable relative to the upper plate and the lower part is generally cylindrical, centered on the axis, and fixed rotationally on the lower plate. The clutch is also normally provided between the lower plate and part and the support.

In such a rotator the mechanism for rotating the valve is connected with the clutch so that it turns with the valve. Thus the system always rotates the valve dependent on the inertia of the mechanism as well as on the friction of the valve on its seat. By doing away with a positive control which normally requires quite a bit of structure, it is possible to lighten the structure attached to the upper spring plate. Thus the arrangement can be used in high-RPM engines.

In the system of the instant invention the cylindrical lower part is formed with a surface inclined to the axis, and the upper part has a follower axially engageable with this surface. This surface is hardened in order to minimize wear. This can be done either by hardening the surface in a surface-treatment operatin, or by providing a layer of harder material on this surface and securing it in place by welding or an appropriate adhesive. The most effective valve rotation has been found to be achieved when this surface is so inclined that on each valve stroke the stem is rotated about the axis between 6° and 12°.

According to this invention the upper part can have a roller engaging the surface. The spring is a generally helical compression spring surrounding or at least coaxial with the various parts.

It is also possible according to this invention to provide an axial-thrust bearing between the lower end of the spring and the lower plate. This structure eliminates the necessity of the spring rotating with the valve. Furthermore, in such an arrangement it is normal that the lower part is a sleeve surrounding the spring and carried via the clutch on the support.

Rotation of the valve both when it opens and when it closes is achieved when the rotator according to this invention has a second such pair of upper and lower parts respectively carried on the upper and lower plates and lying coaxially within the spring and the sleeve. These surfaces are oppositely inclined and normally of different pitch. The two clutches are effective in the same direction.

It is also possible according to the instant invention to make the system very compact. This done in an arrangement wherein the upper and lower parts are axially telescoping, with one of these parts being formed with a groove having a surface inclined to the axis and the other part being formed with a recess provided with a ball riding on this surface. In addition the upper part of such an arrangement is received within the lower part and the lower part is formed with several such recesses having respective such balls and the upper part has respective grooves receiving the balls. These grooves are generally helical and of constant pitch. In such an arrangement the lower part is connected via the clutch with the support. Bolts secure the plates to the support and permit limited vertical displacement of the plates relative to the support. In order to center this structure on the valve stem, the lower part has a rounded inner periphery closely juxtaposed with the upper part. Furthermore, for compactness the upper part is a sleeve tightly surrounding the stem.

The system according to the instant invention is particularly advantageous because of its distribution of mass. Only minor structure need be mounted on the upper spring plate, as the clutch, slide connection, and so on are provided elsewhere. These parts are mounted at the bottom of the structure where they do not get in the way and where they cannot interfere with the functioning of the valve. The low mass of the system makes it ideal for high-speed engines, although the system will function even at low speed to rotate the valve it is associated with.

DESCRIPTION OF THE DRAWING

The above and other features and advantages will become more readily apparent from the following, reference being made to the accompanying drawing in which.

SPECIFIC DESCRIPTION

Figure 1:
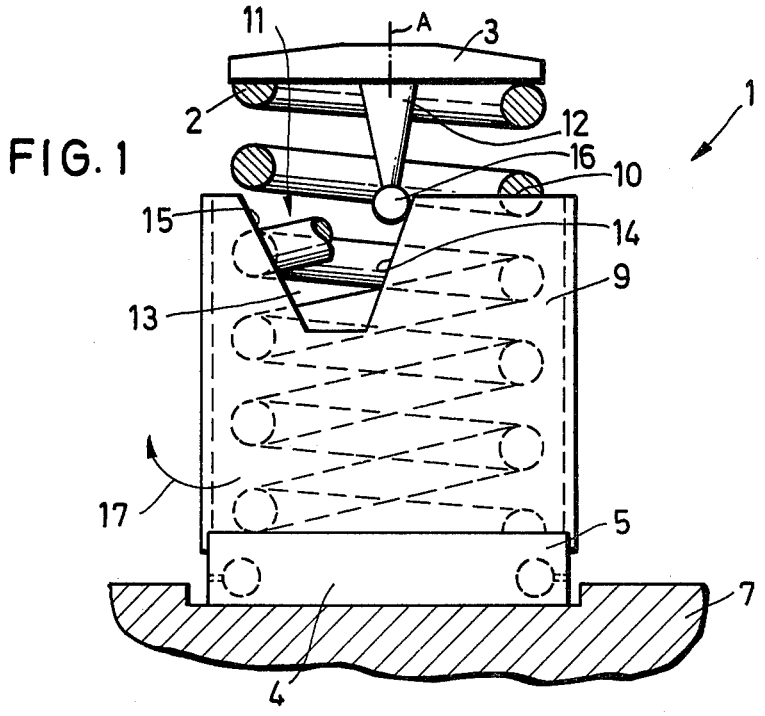
FIG. 1 is a partly sectional side view of the rotator according to this invention.
Figure 2:
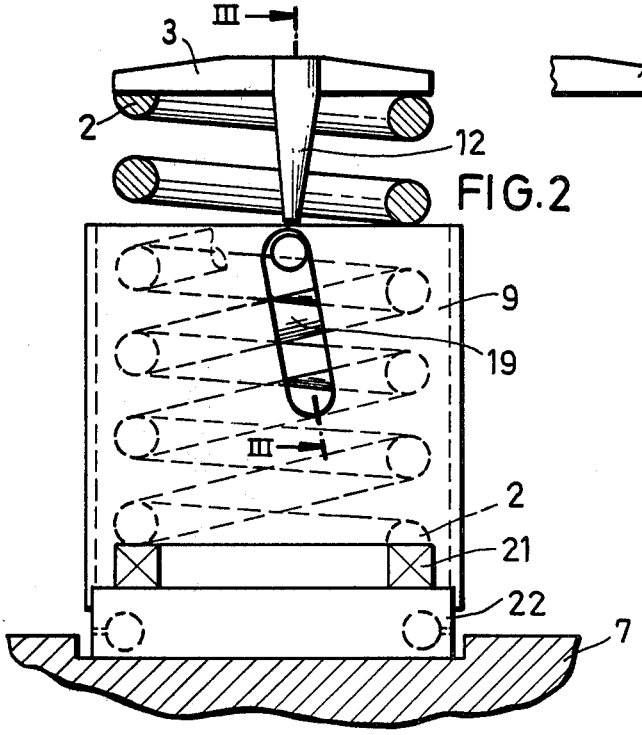
FIG. 2 is a view similar to FIG. 1 showing a second rotator according to this invention.
Figure 3:
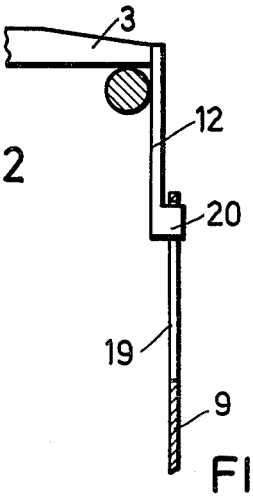
FIG. 3 is a section taken along line III—III of FIG. 2.

As seen in FIG. 1 a valve rotator accrding to this invention has a helical coil spring 2 centered on an upright axis A and braced between an upper spring plate 3 and a lower spring plate 4, the latter incorporating a one-way clutch 5 by which it is connected to a support constituted by the cylinder head 7. A lower part of a link element is formed as a cylindrical sleeve 9 centered on the axis A and carried on the lower plate 4 and the upper part of this link element is formed by a downwardly extending arm or finger 12 carried on the upper plate 3.

This lower-part sleeve 9 is formed with an upwardly open V-section notch 13 having inclined flanks or edge surfaces 14 and 15. The arm 12 carries a follower or end part 16 that normally engages the flank 14. The spring 2 is preloaded so that the follower 16 is urged angularly against this flank 14.

As the valve connected via this valve stem to the upper plate 3 opens, the arm 12 slides with its end 16 along the flank 14. This action does not turn the sleeve 9 since it is blocked against rotation in this direction by the clutch 5. Thus the upper plate 3 and the valve stem connected to it are rotated. As the valve closes and the plate 3 moves upwardly the valve is again rotated. At high engine RPM this motion is virtually continuous.

Figure 4:
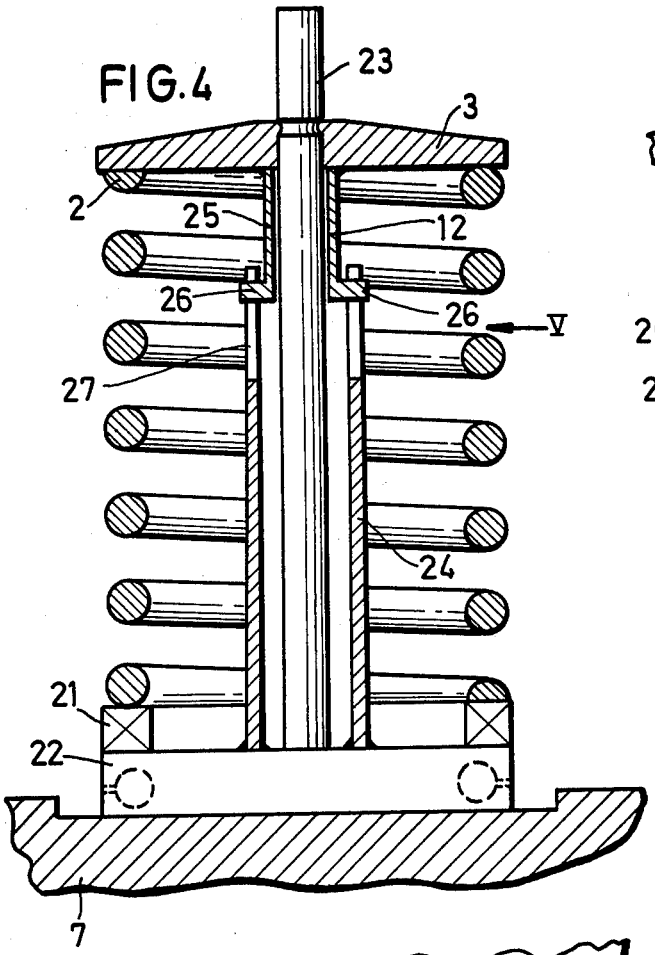
FIG. 4 is an axial section through the rotator of FIGS. 2 and 3.
Figure 5:
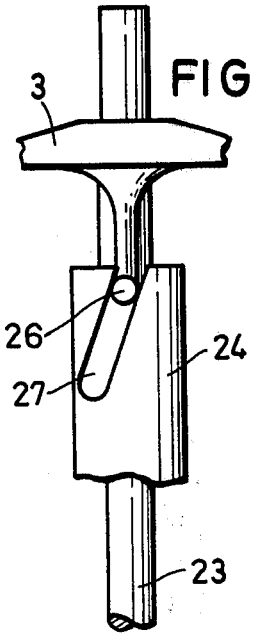
FIG. 5 is a side view taken in the direction of arrow V of FIG. 4.

FIGS. 2–5 show another arrangement, with reference numerals identical to those of FIG. 1 referring to identical structure. Here the arm 12 has a follower 20 engaged in an inclined slot 19 of the lower-part sleeve 9. In addition the spring 2 sits via a one-way clutch 21 atop a lower plate 22 on the cylinder head 7. Inside the structure shown in FIGS. 4 and 5 is another lower part 24 formed with two inclined slots 27 and another upper part 25 having two followers 26 engaged in these slots 27. The outer slot 19 is inclined oppositely, and at a different angle, to the inside slots 27. The valve stem 23 extends axially through the apparatus and is shown fixed to the upper plate 3.

With this arrangement the valve connected to the stem 23 is stepped an increment angularly both on lifting from and on returning to its seat. This makes a wiping action which keeps the valve seat clean and ensures a good fit between the valve and its seat. In this arrangement like in most of the others, the direction the one-way clutch is effective does not matter greatly. The effective direction merely determines normally whether the spring is loaded on lifting and unloaded on returning, or vice versa.

Figure 6:
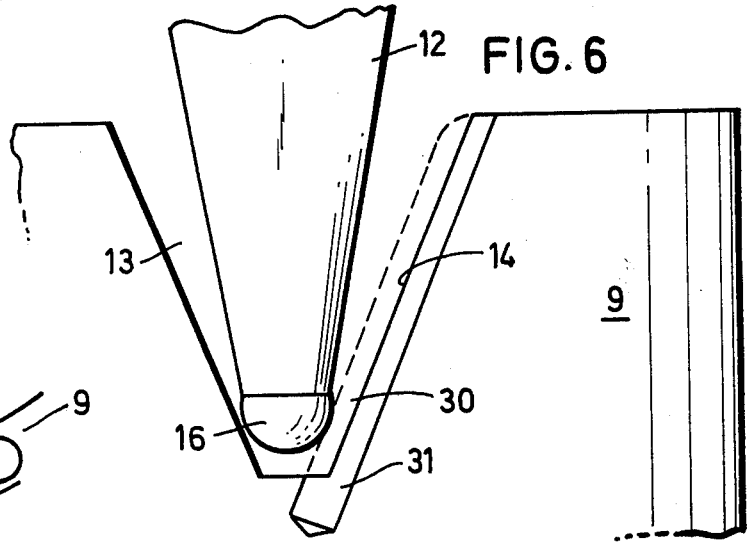
FIG. 6 is a large-scale view of a detail of the rotator of this invention.
Figure 7:
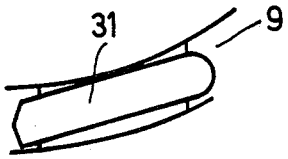
FIG. 7 is a top view of the detail of FIG. 6.

FIGS. 6 and 7 show how the edge 14 can be grooved and counterbored out at 31 to receive a rod 30 of hard material on which the hardened tip 16 rides. As this is the main part of wear of the system, thus hardening the edge 14 greatly increases the service life of the arrangement.

Figure 8:
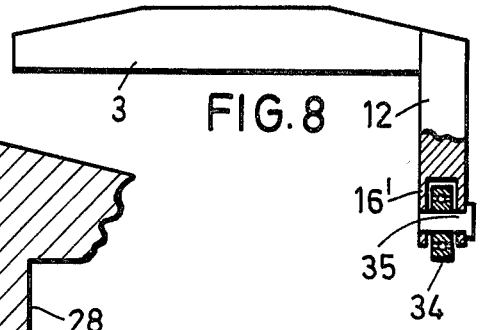
FIG. 8 is a partly sectional view of a detail of a variant of the instant invention.

In FIG. 8 the arm 12 is provided on its lower end with a follower 16' having a short axle 35 provided with a ball-bearing roller 34. Obviously changing from sliding to rolling contact on the flank edge 14 greatly reduces wear thereof.

Figure 9:
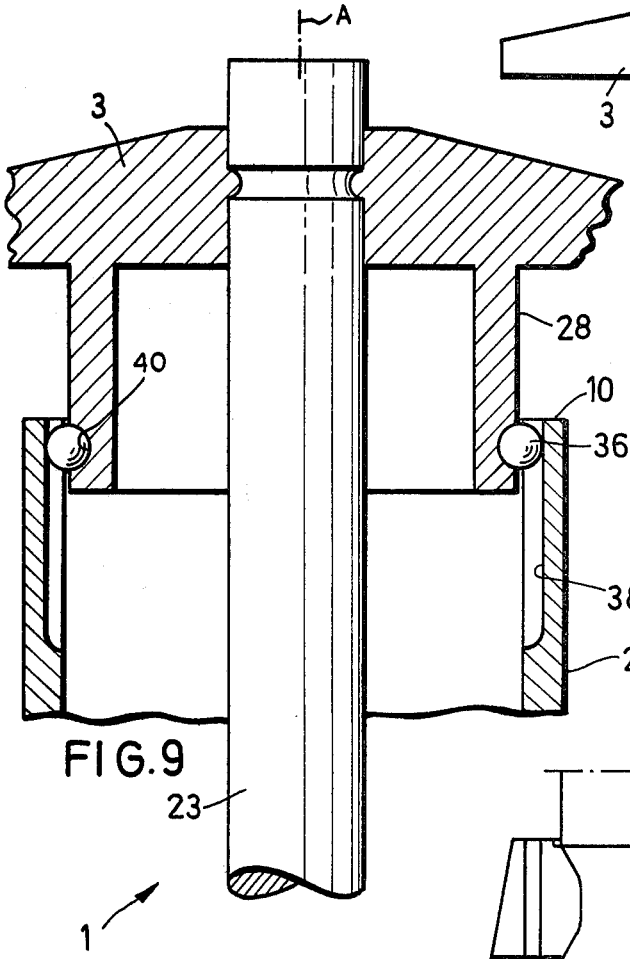
FIG. 9 is an axial section through a third rotator according to this invention.

The arrangement of FIG. 9 uses a top plate 3 having an upper link part 28 formed as a downwardly extending inner sleeve telescoping inside a lower part 29. This upper part 28 is formed with a plurality of semispherical recesses 40 receiving respective balls 36 each also engaged in a respective inclined groove 38 of the lower part 29. These balls 36 are of somewhat softer material than the parts 28 and 29. Thus all the wear of the arrangement will be concentrated in these balls 36 so that the entire system can be rebuilt relatively easily by being telescoped apart and having its balls 36 replaced.

Figure 10:
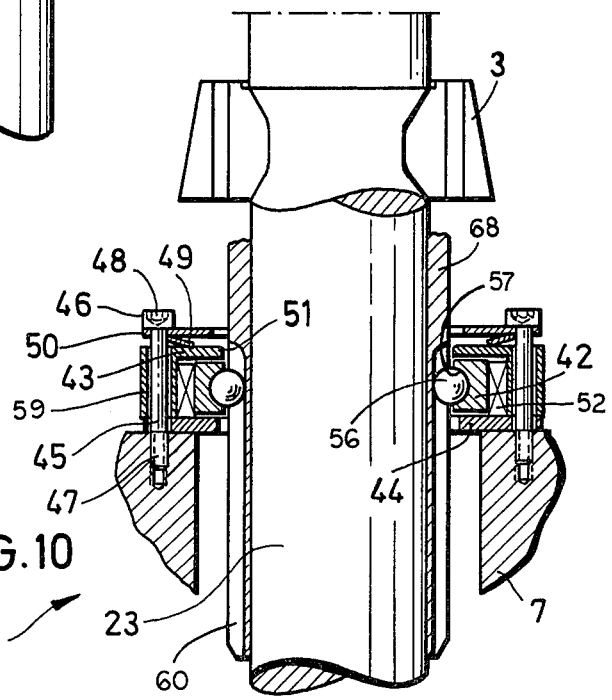
FIG. 10 is an axial section through a fourth rotator according to the present invention.

Finally FIG. 10 shows an arrangement which is extremely compact. Here the valve stem 23 carries an upper part 68 formed with inclined groove 60 receiving balls 56 carried in respective seats 57 formed in an inner ring 42 couplable via sprags 52 with an outer clutch part 59 also forming a lower spring plate 43. A single Belleville washer spring 49 is braced between this plate 43 and an upper plate 50. Bolts 45 pass through the plates 43 and 50, as well as through the ring 59 and are threaded at 47 into the cylinder head 7. These bolts have heads 46 formed with hexagonal Allen-key sockets 48 and bear downwardly on the upper plate 50. The plate 43 is of smaller inner periphery than the upper plate 50 and than the ring 59 formed integrally with it and has a rounded edge 51 so that it is self-centering on the valve stem 23, since the bolts 45 are loosely received in the respective holes.

This system works substantially the same as the others described above. The sprags 22 form with the rings 42 and 59 a one-way clutch of standard design for the angular stepping of the valve stem 23 according to this invention.

I claim:

1. A valve rotator effective between a valve stem and a support, said rotator comprising:

an upper spring plate;

a lower spring plate spaced along an axis below said upper plate and rotatable about said axis relative to said upper plate;

a compression spring braced axially between said plates;

a two-part link element having an upper part rotationally secured to said stem and a lower part rotationally fixed in at least one rotational direction relative to said axis on said lower plate, said lower part being generally cylindrical, centered on said axis, fixed rotationally on said lower plate, and formed with a surface inclined to said axis, said upper part having a follower axially engageable with said surface; and a unidirectional clutch between said lower plate and part and said support and permitting said lower part to rotate about said axis only in said one direction relative to said support, said lower part being a sleeve surrounding said spring and carried via said clutch on said support.

2. The rotator defined in claim 1 wherein said surface is hardened.

3. The rotator defined in claim 1 wherein said surface is so inclined that on each valve stroke said stem is rotated about said axis between 6° and 12°.

4. The rotator defined in claim 1 wherein said upper part has a roller engaging said surface.

5. The rotator defined in claim 1 wherein said spring is a generally helical compression spring surrounding said parts.

6. The rotator defined in claim 1, further comprising a second such pair of upper and lower parts respectively carried on said upper and lower plates and lying coaxially within said spring and said sleeve, said surfaces being oppositely inclined.

* * * * *